United States Patent [19]

Kinkel et al.

[11] Patent Number: 4,774,030

[45] Date of Patent: Sep. 27, 1988

[54] EVAPORATIVE COOLER HAVING EFFICIENT AIR TRANSFER SYSTEM

[76] Inventors: Steve Kinkel, 5419 East Calle Del Medio, Phoenix, Ariz. 85018; Peter J. Kinkel, 2501 East Avalon Dr., Phoenix, Ariz. 85016

[21] Appl. No.: 80,829

[22] Filed: Aug. 3, 1987

[51] Int. Cl.[4] ..... B01F 3/04

[52] U.S. Cl. ..... 261/29; 261/64.1; 261/105; 261/106; 261/DIG. 4

[58] Field of Search ..... 261/29, 64.1, 105, 106, 261/DIG. 4

[56] References Cited

U.S. PATENT DOCUMENTS

| | | | |
|---|---|---|---|
| 2,379,932 | 7/1945 | Schoepflin et al. | 261/29 |
| 2,730,905 | 1/1956 | Pence | 261/29 |
| 3,437,319 | 4/1969 | Engalitcheff, Jr. et al. | 261/29 |
| 3,867,486 | 2/1975 | Nagele | 261/DIG. 4 |
| 3,978,174 | 8/1976 | Peer | 261/29 |
| 4,101,609 | 7/1978 | Sumrow | 261/105 |
| 4,400,185 | 8/1983 | Goettl | 55/257 |
| 4,428,890 | 1/1984 | Harrell | 261/29 |

*Primary Examiner*—Tim Miles

*Attorney, Agent, or Firm*—Don J. Flickinger; Jordan M. Meschkow

[57] ABSTRACT

An improved evaporative cooler is disclosed which includes a highly efficient air transfer system and an effective system for closing off the conditioned space from the ambient when the cooler is out of service. The air transfer system includes a vertically oriented shroud having an air intake region situated at the top, an air exhaust region situated at the bottom and an imperforate intermediate region continuously connecting the intake and exhaust regions. The intermediate region diverges smoothly downwardly, and a horizontally disposed fan is centrally disposed at the shroud bottom. The efficient intake of air into the shroud is promoted by a circumferential lip extending completely around the air intake region, the lip curling smoothly inwardly and arcuately. Effective seasonal sealing is achieved with an optional shroud sealing system supported on the shroud intake region. Preferably, the sealing system is a shutter assembly including a series of parallel shutter elements having closed (overlapping) and open positions. The shutter elements may be either horizontally arrayed directly across the air intake region or may be vertically arrayed on a shutter frame supported on and extending upwardly from the air intake region. A coupling rod connected to each shutter element and to an actuator, which may be manually-operated or solenoid-operated, serves to move the shutter elements between their alternative positions.

11 Claims, 2 Drawing Sheets

FIG. 1
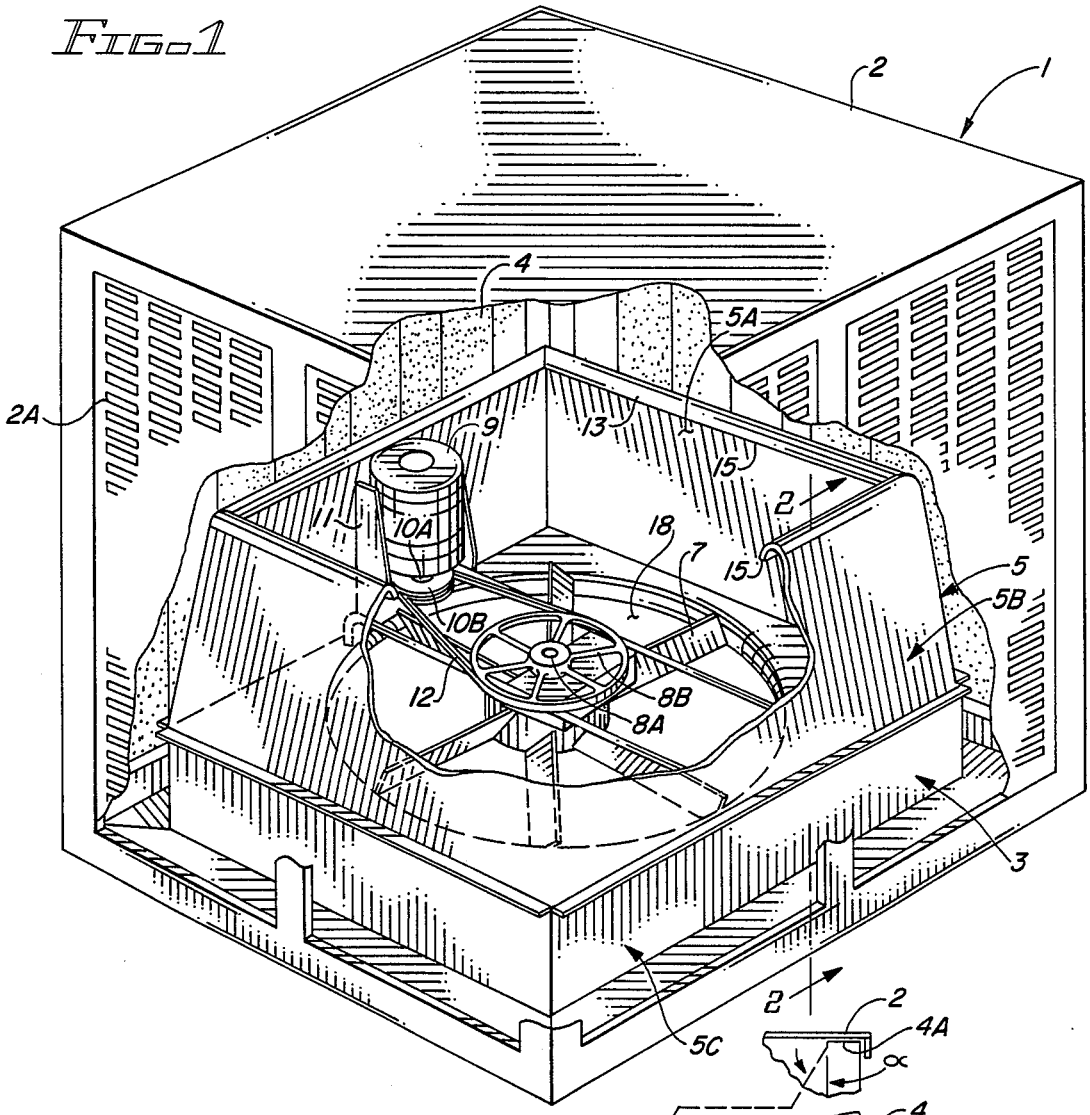
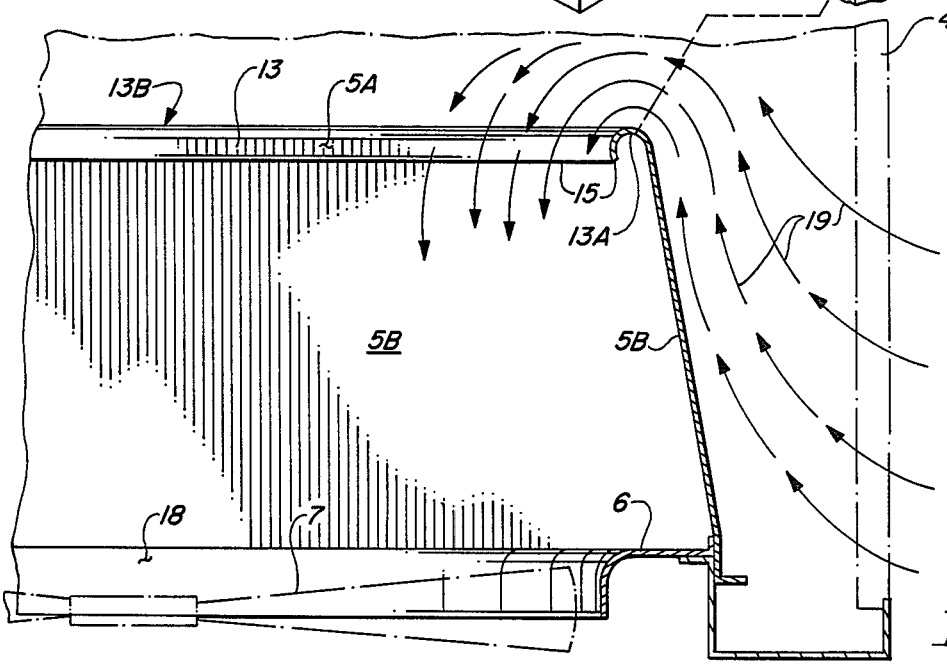
FIG. 2

WEATHER CAP

EVAPORATIVE COOLER HAVING EFFICIENT AIR TRANSFER SYSTEM

BACKGROUND OF THE INVENTION

This invention relates to the art of evaporative cooling and, more particularly, to an evaporative cooler employing a highly efficient air transfer system and also including an effective system for sealing off the space conditioned by an evaporative cooler from the ambient when the evaporative cooler is out of service.

BRIEF DESCRIPTION OF THE INVENTION

Evaporative coolers have enjoyed substantial favor over the years as mechanisms for cooling and conditioning enclosed spaces in hot, arid regions such as the southwestern portion of the United States. As an alternative cooling system to conventional refrigeration air conditioning, evaporative coolers consume much less energy; as a result, evaporative coolers have been the subject of renewed interest recently because of the remarkably increased costs of electrical energy and hence the cost of running an air conditioning system. Thus, evaporative coolers, in a refined state, are sometimes found as the only cooling system for a conditioned space or as an alternative mechanism in a cooling system which also includes an air conditioner, the evaporative cooler performing the space cooling function during periods of relatively low humidity and the air conditioner being employed only when the humidity increases to a level at which the evaporative cooler becomes inefficient and tends to raise the humidity of the space being conditioned to an uncomfortable level. The resurgence of interest in the technology of evaporative cooling has resulted in advances in the materials employed (such as the cooling pads), the water handling systems and the air transfer systems, all with a view toward providing evaporative coolers which are efficient and relatively trouble free. Nonetheless, there remains room for substantive improvement in all such areas, and the efficiency of the air transfer system within evaporative coolers is an especially fertile province to undertake improvement in order to increase the air transfer efficiency to achieve a smaller, quieter and more energy efficient unit for a given capacity. The present invention addresses this need directly.

As is well known in the art, evaporative coolers draw outside air across a wetted pad (to cool the air by evaporation) and deliver the cooled air to an interior space. As a result, during periods of cold weather in which the interior space is heated by some other means, it is necessary to effectively seal off the air path through the evaporative cooler between the outside ambient and the space interior in order to prevent undue heat loss. Similarly, in a dual cooling system, when the switchover is made to air conditioning, the same path must be effectively sealed to prevent the loss of refrigerated air through the evaporative cooler. Numerous approaches and contrivances have been employed to more or less satisfactorily achieve this end, but those skilled in the art will appreciate that it would be highly desirable to provide a simple and very effective means for performing this seasonal sealing function without the necessity for accessing the evaporative cooler interior, and the present invention also is responsive to this need.

OBJECTS OF THE INVENTION

It is therefore a broad object of this invention to provide an improved evaporative cooler.

It is another object of this invention to provide an evaporative cooler having a highly efficient air transfer system.

It is yet another object of this invention to provide such an evaporative cooler which includes a horizontally oriented fan disposed at the bottom of a specially configured shroud which promotes smooth and efficient intake into and transfer through the shroud.

In another aspect, it is an object of this invention to provide such an evaporative cooler which includes simple and efficient seasonal sealing apparatus.

It is still another object of this invention to provide such an evaporative cooler in which the seasonal sealing apparatus may be actuated, manually or by electrical signal, without the necessity for accessing the interior of the cooler.

SUMMARY OF THE INVENTION

Briefly, these and other objects of this invention are achieved in an evaporative cooler which includes a housing having at least one inlet for introducing ambient air into the housing interior and at least one wetted pad element disposed intermediate the inlet and the interior of the housing such that ambient air drawn through the inlet into the housing passes through the wetted pad and is cooled by evaporation. Disposed within the cooler housing is an air transfer system arranged between the inlet and an outlet into a cooled and conditioned space. The air transfer system includes a vertically oriented shroud, typically disposed in a downdraft configuration, with an air intake region situated at the top, an air exhaust region situated at the bottom and an imperforate intermediate region continuously connecting the intake and exhaust regions. The intermediate region diverges smoothly from a minimum cross sectional area at the air intake region to a maximum cross sectional area at the air exhaust region. A circular exhaust opening is provided in the air exhaust region for delivering cool air to the conditioned space, and a horizontally disposed, multi-bladed fan is centrally positioned in the circular exhaust opening. In a preferred embodiment, the shroud is generally square in cross section, and the efficient intake of air into the shroud is promoted by a peripheral lip extending completely around the air intake region, the lip curling smoothly inwardly and arcuately from an outside boundary which merges with the intermediate shroud region to an inner terminus effecting an edge having a periphery which determines the effective area available for air flow into the air intake region and through the shroud.

In order to provide effective sealing between the ambient and the space to be cooled during periods in which the evaporative cooler is not in use, a shroud sealing system supported on the shroud intake region is provided to selectively substantially close off the intake region. Preferably, the sealing system is a shutter assembly including a series of parallel shutter elements actuable in unison between first and second positions, the shutter elements, when in the second position, overlapping to substantially close off the intake region to thereby prevent the passage of air into or out of the shroud. The shutter elements may be either horizontally arrayed directly across the air intake region or vertically arrayed on a shutter frame supported on and extending upwardly from the air intake region. A coupling rod pivotally connected to each shutter element and to an actuator, which may be manually-operated or solenoid-operated, serves to move the shutter elements between their alternative open and closed positions.

BRIEF DESCRIPTION OF THE DRAWINGS

The subject matter of the invention is particularly pointed out and distinctly claimed in the concluding portion of the specification. The invention, however, both as to organization and method of operation, may best be understood by reference to the following description taken in conjunction with the subjoined claims and the accompanying drawing of which:

FIG. 1 is a partially broken away three-quarter perspective view illustrating the internal structure of an evaporative cooler, particularly an air transfer system, which is characteristic of the subject invention;

FIG. 2 is a cross sectional view taken along the lines 2—2 of FIG. 1 and particularly shows a preferred configuration for a shroud air intake region which promotes the highly efficient flow of air into the shroud and through the cooler and also shows a preferred disposition for the top of the shroud air intake region with respect to the top of a wetted pad element;

DETAILED DESCRIPTION OF THE PREFERRED EMBODIMENT

Figure 3:
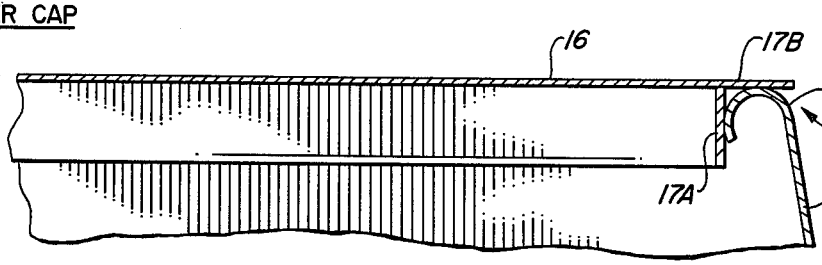
FIG. 3 illustrates a simple cap configuration for sealing the air intake region of the shroud.

Referring now to FIG. 1, an exemplary downdraft evaporative cooler 1 includes a housing 2 and an air transfer system generally indicated at 3. A wetted pad 4 is disposed between the louvered sides 2*a* of the housing 2 and the interior of the housing such that ambient air drawn through the louvered sides, which effect an inlet into the housing, passes through the wetted pad and is cooled by evaporation. The air transfer system 3 serves to provide the pressure differential which causes the ambient air to be drawn into the inlets through the housing 2 across the pad 4 and into a conditioned and cooled space in communication with an air exhaust region 6 situated at the bottom of the air transfer system 3.

More particularly, the air transfer system 3 includes a shroud 5 having an air intake region 5*a* generally defined by peripheral lip 13 and an air exhaust region 5*c* generally disposed at the bottom of the air transfer system 3. The region between the air intake region 5*a* and the air exhaust region 5*c* is an imperforate intermediate region 5*b* which diverges smoothly from a minimum cross sectional area at the air intake region to a maximum cross sectional area at the air exhaust region. In one preferred embodiment, the cross section of the shroud 5 is generally square and includes a floor area 6 in which a centrally disposed circular opening 18 is provided to effect an exhaust outlet into a space to be cooled.

A horizontally disposed, multi-bladed fan 7 is situated within the circular opening 18 and includes a central fan shaft 8*a* which carries a driven pulley 8*b*. An electric motor 9 is vertically supported within the shroud 5 in a position proximate one wall of the shroud, and a central motor shaft 10*a* depends downwardly from the vertically oriented motor 9 and carries driving pulley 10*b*. Flexible drive belt 12 extends around the driving pulley 10*b* and the driven pulley 8 for coupling the motor 9 to the fan 7 to drive the fan which pulls air through the inlet 2*a* into the shroud intake region 5*a*, through the shroud 5 and across the fan 7 for discharge under pressure through the opening 18 past the cooler outlet and into the cooled space. Wings 11, extending inwardly on either side of the motor 10 from the shroud intermediate region 5*b*, serve to partially shield the motor from water in the event that a transient condition should result in the circulation of an excess quantity of water drops in the air flow through the shroud 5.

An important characteristic of the air transfer system 3 is its efficiency of operation. A significant feature which promotes the efficiency is the specific configuration of the peripheral lip 13 at the air intake region 5*a*. As best shown in the cross sectional view of FIG. 2, the peripheral lip 13, extending completely around the air intake region 5*a*, curls smoothly inwardly and arcuately, as at 13*a*, from an outside boundary which merges with the intermediate shroud region 5*b* to an inner edge 15 having a periphery which determines the effective area available for air flow through the air intake region 5*a*. As a result, as indicated by the arrows 19, a smooth transfer of ambient air which has been drawn into the cooler housing 2 takes place into the air intake region 13*b* and into the interior of the shroud 5, past the fan 7 and into the space to be cooled. This arrangement promotes an equal and even face velocity of the air across the entire surface area of the inlet region 5*a* and through the shroud 5. By way of a specific example of the contribution of the specific configuration for the air intake region provided with the circumferential lip 13 as opposed to an otherwise substantially identical air intake region without the peripheral lip, directly equivalent tests show a air transfer rate of 7805 cubic feet per minute in the latter and 9160 cubic feet per minute in the former.

Another feature of the air transfer system 3 is that the vertical position of the air intake region 5*a* with respect to the topmost edge 4*a* of the wetted pad 4 is such as to insure that droplets of water pulled away from the wetted pad, under industry standard air flow rate conditions, falls on the outer surface of the shroud 5 and therefore protects the motor 9 and the bearing assemblies of the motor and fan 7 from water damage. It has been found that if the angle alpha is greater than about twenty degrees and the air flow rate does not exceed about 160 feet per minute (an industry standard), then this objective is achieved because the gravitational force exerted on any droplets pulled from the wetted pad 4, even from its highest edge 4*a*, is sufficient to affect the droplet's curvature of descent such that it will not enter the air intake region 5*a*.

One subtle advantage to the interior structure of the subject evaporative cooler as described above is that the shroud 5 secondarily functions as an effective safety shield when the interior is accessed. The motor 9, drive belt 12 pulleys 8, 10 and fan 7 are all positioned well below the easily reached regions of the interior of the housing 2, and the amateur workman is discouraged from undertaking the additional effort necessary to gain direct access to these moving components.

The configuration for the air transfer system illustrated in FIG. 1 has the additional advantage that it is receptive to effective seasonal sealing between the ambient and the interior of the shroud 5 (and hence the cooled space) during periods when the cooled space is either heated or is cooled by air conditioning. Thus, referring now to FIG. 3, it will be seen that a simple weather cap 16, having peripheral vertical 17*a* and horizontal 17*b* guide/support members, may simply be inserted into the air intake region 5*a* of the shroud 5 for peripheral support by the lip 13. However, in order to install the weather cap 16, it is manifestly necessary to physically gain access to the interior of the housing 2 (FIG. 1) in order to insert or remove the weather cap 16. Thus, while the weather cap 16 performs its office very effectively, it will be appreciated that it would be preferable to provide apparatus by which the sealing and unsealing operations may be performed without the necessity to gain access to the interior of the cooler housing.

Figure 4:
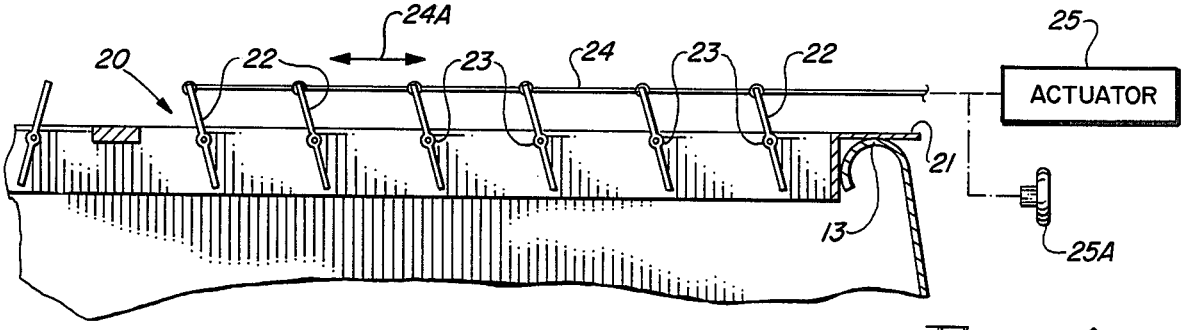
FIG. 4 illustrates a manually or electrically actuable shutter assembly extending across the shroud intake region such that the shutter assembly element may be moved between alternative open and closed positions to selectively seasonally seal the cooler.
Figure 5:
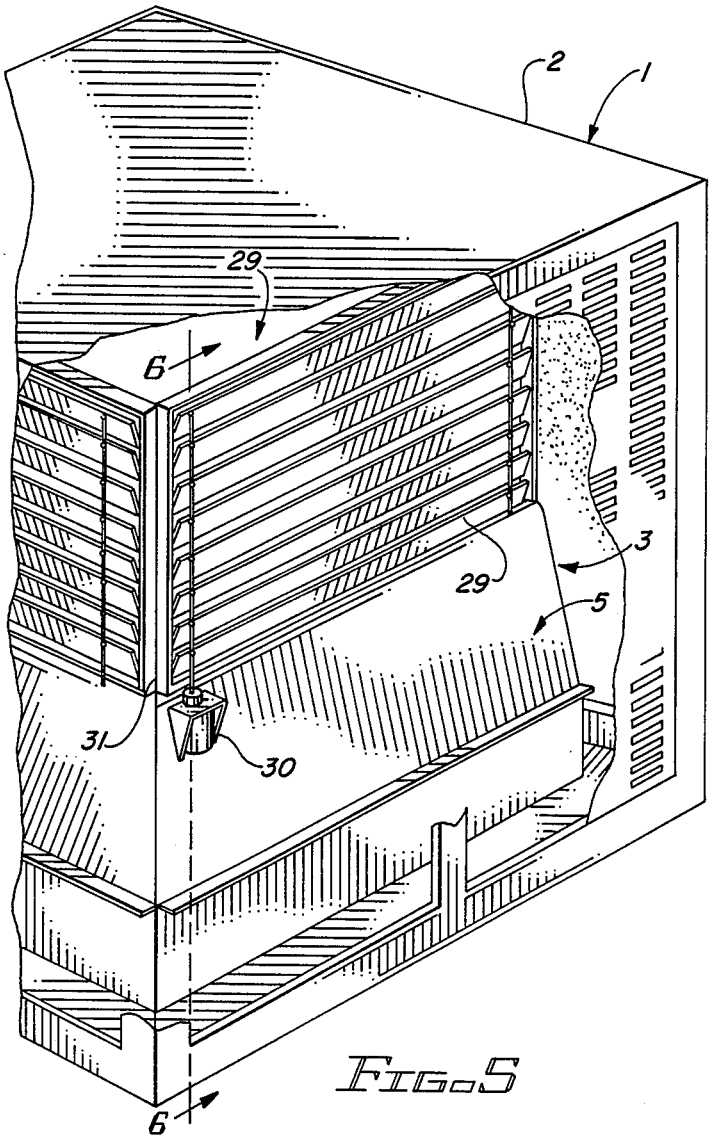
FIG. 5 is a partial three-quarter perspective view of an alternative embodiment of the invention illustrating a frame carrying a vertically oriented shutter assembly for providing the selective sealing function.

Referring to FIG. 4, there is shown a shutter assembly 2 supported by peripheral guide/support member 21 atop lip 13 of the air intake region 5*a* of the air transfer system. The shutter assembly 20 includes a plurality of parallel shutter elements 22 which effect the shroud sealing assembly. A coupling rod 24 is pivotally connected to each shutter element 22 at the same coupling position offset from the axes of rotation 23 of the shutter elements. Thus, as the coupling rod 24 is moved back and forth as indicated by the arrow 24*a*, the shutter assembly may be shifted between alternative closed (and overlapping) and open positions. This operation can be carried out by an actuator which may be an electrically energized solenoid 25 or by manipulating a manually operable knob 25*a* which extends outside the housing 2 of the cooler 1. Thus, the shutter assembly 20 may be either opened or closed without the necessity to access the interior of the housing 2 by providing the appropriate electrical signal to the electrically-energized actuator 25 or, in the manually actuable configuration, by simply grasping the knob 25*a* and pulling or pushing the coupling rod 24 as the operation may require.

For those applications in which a larger air flow volume is required, increased flow capacity through the seasonal sealing system may be achieved by supporting one or more vertical shutter assemblies 29*a* on a shutter assembly frame 29 atop the air transfer system 3. The vertically oriented shutter assemblies 29*a* may be provided on more than one side of the frame 31, including all four sides, such that little resistance to the flow of air into the shroud 5 is encountered.

Figure 6:
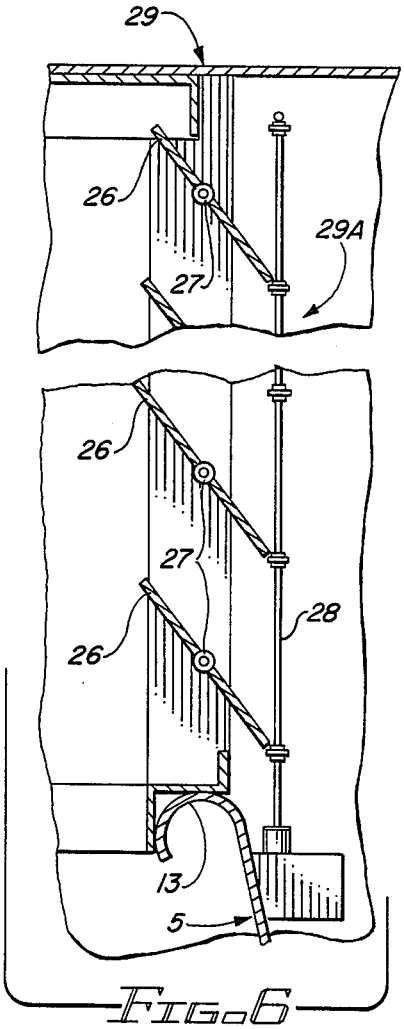
FIG. 6 is a partially broken-away cross sectional view taken along the lines 6—6 of FIG. 5 to illustrate certain structural details of the vertical shutter assembly.

Referring to FIG. 6, each array 29*a* of shutters in the shutter assembly frame 29 includes parallel shutter elements 26 pivoting about axes 27 and connected together by coupling rod 28 which terminates in an actuator such as electrically-operated solenoid 30. Thus, as electrically-operated solenoid 30 (or a manually-actuable equivalent) throws the shutter elements 26 to their alternative open and closed (and overlapping) positions, the interior of the air transfer system 3 is selectively opened to receive ambient air or closed off to seal the interior of the air transfer system 3, and hence the cooled space, during periods in which the space is either heated or is cooled by air conditioning.

Thus, while the principles of the invention have now been made clear in an illustrative embodiment, there will be immediately obvious to those skilled in the art many modifications of structure, arrangements, proportions, the elements, materials, and components, used in the practice of the invention which are particularly adapted for specific environments and operating requirements without departing from those principles.

What is claimed is:

1. An evaporative cooler comprising:

(A) a cooler housing, said cooler housing including:

(i) at least one inlet for introducing ambient air into the interior of said housing;

(ii) at least one vertically oriented wetted pad element disposed intermediate said inlet and the interior of said housing such that ambient air drawn through said inlet into said housing passes through said wetted pad; and (iii) an outlet for delivering cooled air from the interior of said housing;

(B) an air transfer system situated in the interior of said housing intermediate said inlet and said outlet, said air transfer system comprising a vertically oriented shroud, a horizontally disposed, multi-bladed fan, a vertically oriented motor and a flexible drive belt:

(i) said vertically oriented shroud being generally square in cross section and including a horizontally disposed square air intake region, an air exhaust region and an imperforate intermediate region, said shroud being further characterized in that:

said horizontally disposed square air intake region is situated at the top of said shroud and includes a square peripheral lip extending completely around said air intake region, said square peripheral lip curling smoothly inwardly and arcuately from an outside boundary which merges with said intermediate shroud region to an inner terminus effecting an edge which determines the effective area available for air flow through said air intake region;

the vertical position of said air intake region within said housing being selected such that the angle between said peripheral lip and an uppermost edge of said wetted pad element exceeds about twenty degrees measured at said uppermost edge and with respect to the vertical;

said air exhaust region is situated at the bottom of said shroud, said air exhaust region including a floor;

said imperforate intermediate region continuously connects said air intake region and said air exhaust region, said intermediate region diverging smoothly from a minimum cross sectional area at said air intake region to a maximum cross sectional area at said air exhaust region; and a circular exhaust opening is provided in said floor area of said air exhaust region;

(ii) said horizontally disposed, multi-bladed fan being centrally disposed in said circular exhaust opening, said fan including:

a central fan shaft; and a driven pulley fixed to said fan shaft and coaxially oriented with respect thereto;

(iii) said vertically oriented electric motor being supported and contained within said shroud, said motor including:

a central motor shaft; and a driving pulley fixed to said motor shaft and coaxially oriented with respect thereto, said driving pulley and said driven pulley being positioned in horizontal alignment; and (iv) said flexible drive belt extending around said driving and driven pulleys for coupling said motor to drive said fan to pull air through said inlet, into said square shroud intake region, through said shroud and across said fan for discharge under pressure through said outlet into a cooled space.

2. The evaporative cooler of claim 1 which further includes:

a shroud sealing assembly supported on said shroud peripheral lip of said air intake region and adapted to selectively substantially close off said air intake region to prevent the passage of air therethrough to thereby isolate the interior of said shroud and the cooled space from the ambient atmosphere.

3. The evaporative cooler of claim 2 in which said shroud sealing assembly comprises a shutter assembly consisting of a series of parallel shutter elements actuable in unison between first and second positions, said shutter elements, when in said first position, being disposed in non-overlapping relationship to thereby permit substantially unimpeded airflow into said shroud through said air intake region; said shutter elements, when in said second position, overlapping to substantially close off said air intake region and thereby prevent the passage of air therethrough.

4. The evaporative cooler of claim 3 in which said shutter elements are horizontally arrayed across said air intake region.

5. The evaporative cooler of claim 3 in which said shutter assembly is carried on a shutter frame supported on and extending upwardly from said air intake region and in which said shutter elements are vertically arrayed above said air intake region.

6. The evaporative cooler of claim 4 which further includes shutter actuation means for selectively moving said shutter elements between said first and second positions in unison, said shutter actuation means including:

(A) a coupling rod pivotally connected to each shutter element at the same coupling position offset from the axis of rotation thereof; and (B) an actuator for selectively pulling and pushing said coupling rod to move said shutter elements in unison between said first and second positions.

7. The evaporative cooler of claim 6 in which said actuator comprises an electrically actuable solenoid.

8. The evaporative cooler of claim 7 in which said actuator comprises a manually actuable member connected to said coupling rod such that it can be grasped in the hand of an operator and pulled and pushed to cause said shutter elements to move between said first and second positions.

9. The evaporative cooler of claim 5 which further includes shutter actuation means for selectively moving said shutter elements between said first and second positions in unison, said shutter actuation means including:

(A) a coupling rod pivotally connected to each shutter element at the same coupling position offset from the axis of rotation thereof; and (B) an actuator for selectively pulling and pushing said coupling rod to move said shutter elements in unison between said first and second positions.

10. The evaporative cooler of claim 9 in which said actuator comprises an electrically actuable solenoid.

11. The evaporative cooler of claim 10 in which said actuator comprises a manually actuable member connected to said coupling rod such that it can be grasped in the hand of an operator and pulled and pushed to cause said shutter elements to move between said first and second positions.

* * * * *